United States Patent [19]

Nomoto et al.

[11] Patent Number: 4,816,720

[45] Date of Patent: Mar. 28, 1989

[54] DISCHARGE LAMP OPERATING CIRCUIT

[75] Inventors: Ikuya Nomoto, Akigawa; Kenji Kawabata, Ome, both of Japan

[73] Assignee: Hitachi, Ltd., Tokyo, Japan

[21] Appl. No.: 126,790

[22] Filed: Nov. 30, 1987

[30] Foreign Application Priority Data

Dec. 5, 1986 [JP] Japan ..... 61-288796

[51] Int. Cl.[4] ..... H05B 39/00

[52] U.S. Cl. ..... 315/94; 315/224; 315/226; 315/DIG. 2; 315/291; 315/209 R

[58] Field of Search ..... 315/241, 209 R, 219, 315/244, 224, 291, 160, 209 CD, 224, 225, 226, 290, DIG. 2, DIG. 5

[56] References Cited

U.S. PATENT DOCUMENTS

| | | | |
|---|---|---|---|
| 3,978,368 | 8/1976 | Tomura et al. | 315/105 |
| 4,060,752 | 11/1977 | Walker | 315/244 |
| 4,698,553 | 10/1987 | Nilssen | 315/102 |
| 4,700,287 | 10/1987 | Nilssen | 315/102 |
| 4,734,624 | 3/1988 | Nagase et al. | 315/DIG. 2 |

FOREIGN PATENT DOCUMENTS 6047398 3/1985 Japan .

*Primary Examiner*—David K. Moore
*Assistant Examiner*—Michael Razavi
*Attorney, Agent, or Firm*—Antonelli, Terry & Wands

[57] ABSTRACT

A discharge lamp operating circuit includes at least a discharge lamp, a condenser and four switches. The condenser is charged and discharged through the discharge lamp by the turn-on and turn-off of the switches so that an AC current is caused to flow through the discharge lamp to operate the discharge lamp. A time required for the complete charging and discharging of the condenser is selected to be longer than a time scheduled for the charging and discharging of the condenser in one period. A switching frequency $f_0$ at the time of heating of the discharge lamp and a switching frequency f at the time of operating of the discharge lamp has a relation of $2 \leqq f/f_0 \leqq 10$.

1 Claim, 3 Drawing Sheets

DISCHARGE LAMP OPERATING CIRCUIT

BACKGROUND OF THE INVENTION

The present invention relates to an electric ballast circuit for operating or lighting a discharge lamp such as a mercury rare gas discharge lamp, and more particularly to a discharge lamp operating circuit which make use of a condenser as a ballast and operates at a high frequency.

An example of a high frequency discharge lamp operating circuit using a condenser as a ballast is disclosed by JP-A No. 60-47398. The disclosed circuit includes a condenser and semiconductor switches and the condenser is periodically charged and discharged through a discharge lamp by ON/OFF operation of the switches so that a high frequency AC current is caused to flow in the discharge lamp. This discharge lamp operating circuit has an advantage that any inductance is not included, thereby providing possibilities of small size, light weight and low cost.

In the above-mentioned discharge lamp operating circuit, the great improvement of the efficiency of the discharge lamp may be possible by making the capacity of the condenser larger to increase a time constant CR so that the waveform of a voltage applied to the discharge lamp approaches a rectangular wave. However, such an approach results in the problem of an excessive inflow of a heating current to a filament of the discharge lamp and hence the too early blackening of the inner wall of the lamp and/or the burning-out of the filament since the decrease of impedance of the condenser and the resulting increase of the heating current are not taken into consideration.

SUMMARY OF THE INVENTION

An object of the present invention is to provide a discharge lamp operating circuit of a low cost and with a high efficiency and a high reliability by greatly improving the efficiency and making the heating current optimum.

The above object is achieved in such a manner that the impedance of a condenser, when the capacity of the condenser is selected to be a sufficiently large value, is made optimum by carrying out a frequency control at the time of heating where the decrease of the impedance would otherwise give rise to undesirable results.

DESCRIPTION OF THE PREFERRED EMBODIMENTS

The principle of the present invention will first be explained.

Figure 2A:
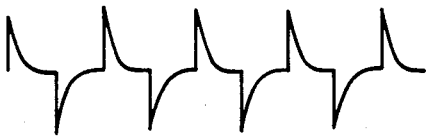
FIG. 2A PRIOR ART
FIGS. 2A and show the waveforms of voltages applied to discharge lamps when the discharge lamps are operated by the conventional circuit and the circuit of the present invention, respectively.
Figure 2B:
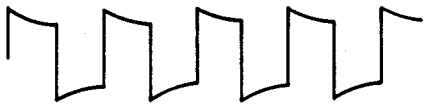

The low efficiency of a discharge amp operating circuit using a condenser as a ballast is caused by the waveform of a voltage or current applied to a discharge lamp. FIG. 2A shows the waveform of a voltage applied to a discharge lamp when the discharge lamp is operated by a conventional circuit. The frequency of the voltage waveform is 50 KHz. For such a frequency, since the discharge lamp can be regarded as a resistor having a linear resistance, the voltage waveform assumes the charging/discharging waveform of a condenser having a time constant of $CR_l$. Here, $R_l$ is the value of the linear resistance and C is the capacity of the condenser. The waveform of a current flowing through the discharge lamp resembles the voltage waveform. In the conventional circuit, the capacity of the condenser as a ballast has been determined such that the charging and discharging of the condenser is completed during one cycle or period of operation. However, such selection of the condenser capacity would provide the cause of unattainableness of high efficiency since the voltage or current of the discharge lamp must change from zero to a predetermined value for each half period. If a part of charges to be charged and discharged during one period are remained or stored in the condenser, that is, a time required for the complete charging and discharging of the condenser is selected to be longer than a time scheduled for the charging and discharging in one period at which the charging and discharging of the condenser is to be actually repeated, the efficiency of the discharge lamp can be improved. FIG. 2B shows the waveform of a voltage applied to the discharge lamp when the capacity of the ballast condenser is increased to make a time constant thereof large. As is shown, the voltage waveform applied to the discharge lamp approaches a rectangular wave and hence the luminous efficiency of the discharge lamp is improved. However, the increase in the capacity of the ballast condenser results in decrease in the impedance of the ballast condenser according to $1/\omega C$. Therefore, the effective value of the current, which offers no problem at the time of normal operating (or lighting) of the discharge lamp, takes an extremely high value at the time of heating and starting. Due to the fact that the load impedance becomes equal to lamp resistance R1 at the time of normal operation of the discharge lamp, although it remains at the value of the filament resistance Rf at the time of heating and starting. Therefore, the resistance value R1 is much greater than the resistance value Rf ($R1 >> Rf$). This increase of current results in the damage of the filament, i.e. the too early blackening of the inner wall of the discharge lamp and/or the burning-out of the filament, thereby extremely deteriorating the reliability of the discharge lamp The present invention is directed to effecting $\omega$ of $1/\omega C$ in order to keep the respective impedances of the condenser at the time of heating. Further, the present invention at the time of operating optimum and has made it possible to keep the respective impedances optimum by setting a frequency at the time of heating to a low value $f_o$ and increasing the frequency to a high value f in a moment after the operating (or lighting) of the discharge lamp.

An embodiment of the present invention will now be explained by virtue of FIG. 1.

Figure 1:
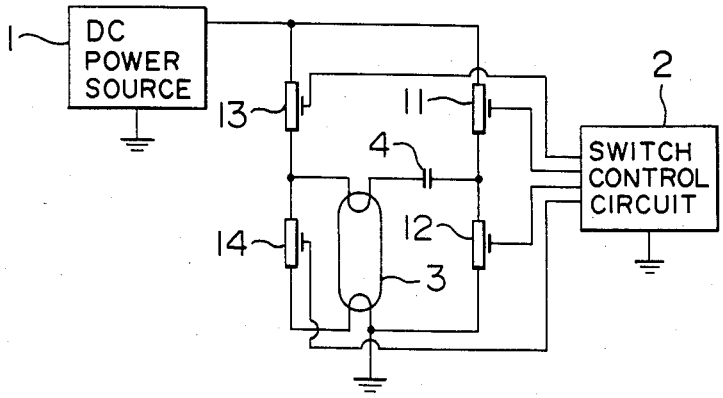
FIG. 1 is a circuit diagram of an embodiment of the present invention.

FIG. 1 shows a circuit diagram of a discharge lamp operating circuit according to an embodiment of the present invention. The discharge operating circuit includes a discharge lamp 3 having two heating type of filament electrodes, a switch control circuit 2, a source 1 of rectified DC voltage, a ballast condenser 4, and four semiconductor switches 11 to 14. The switch control circuit 2 designates the combination of ON and OFF "states" of the four switches 11 to 14 in synchronism with clock pulses of a predetermined operating frequency to effect the charging and discharging of the ballast condenser 4 through the discharge lamp 3, thereby performing the operations of heating of the filament electrodes, starting and normal operating (or lighting).

In operation, the heating of the filament electrodes of the discharge lamp 3 is carried out in such a manner that with the switch 13 turned off and the switch 14 turned on, the switches 11 and 12 are alternately turned on and off at a frequency $f_0$ from the switch control circuit 2 so that the switches 11 and 12 are not simultaneously turned on. The charging and discharging of the condenser 4 through the filament electrodes of the discharge lamp 3 is repeated to heat the filament electrodes. This heating time is 0.4 to 1 seconds.

Next, by turning off the switches 11 and 14 and turning on the switches 12 and 13, the condenser 4 is charged with a polarity reverse to the usual polarity. Thereafter, the switches 12, 13 and 14 are turned off and the switch 11 is turned on so that the sum of the voltage of the power source 1 and the voltage of the condenser 4 is applied to the discharge lamp 3, thereby starting a discharge. Then, the step proceeds to the operation of normal operating or lighting. With th switches 13 and 14 remaining off, the switches 11 and 12 are alternately turned on and off at a frequency f from the switch control circuit 2. The condenser 4 is charged and discharged through the discharge lamp 3 so that an AC current is caused to flow through the discharge lamp 3 and such an operating state of the discharge lamp 3 is maintained.

Figure 3:
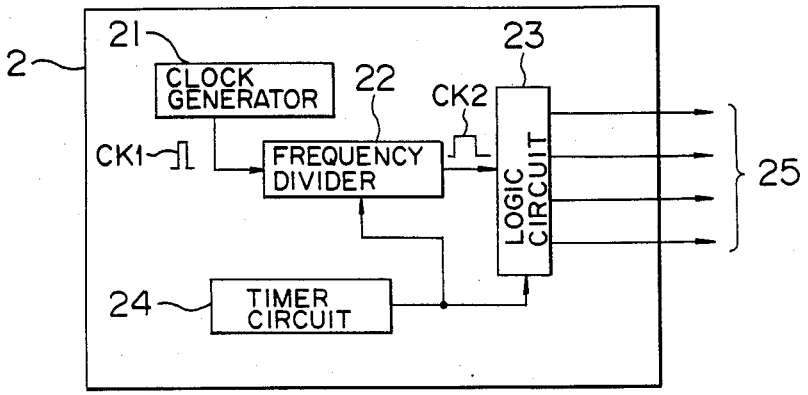
FIGS. 3 and 4 show concrete examples of a switch control circuit shown in FIG. 1.
Figure 4:
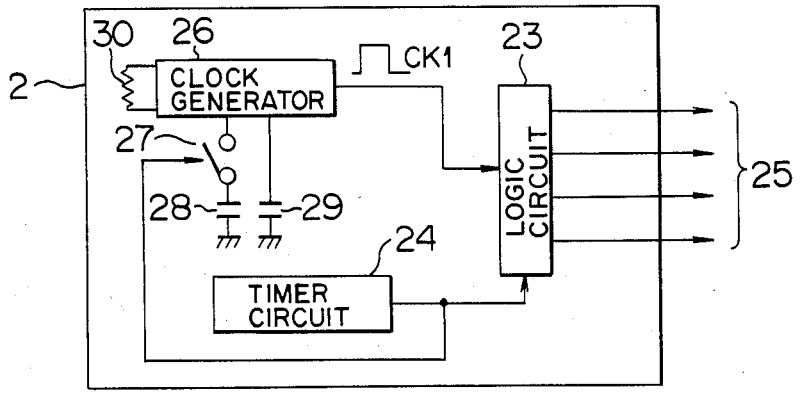

The above-described change-over of frequency for turn-on/off of the switches 11 to 14 can be realized by constructing the switch control circuit 2 as shown in FIGS. 3 or 4.

Referring to FIG. 3, reference numeral 21 designates a clock generator, numeral 22 a frequency divider, numeral 23 a logic circuit, and numeral 24 a timer circuit A clock pulse signal CK1 generated from the clock generator 21 is frequency-divided by the frequency divider 22 so that a signal CK2 having a lower frequency value than the frequency of the clock pulse signal CK1 is applied to the logic circuit 23. On the other hand, an output signal of the timer circuit 24 for determining the heating time is inputted to the frequency divider 22 and the logic circuit 23. The logic circuit 23 produces signals 25 designating the combination of ON and OFF of the switches 11 to 14 on the basis of the signal CK2 from the frequency divider 22 and the signal from the timer circuit 24. Thus, a dividing ratio in the frequency divider 22 can be changed over in accordance with the signal inputted from the timer circuit 24 to the frequency divider 22, thereby changing over the frequency of the signal CK2 at the time of heating and at the time of operating.

FIG. 3 shows the case where the frequency of the clock pulse signal CK1 is fixed. On the other hand, FIG. 4 shows a method in which the frequency of the clock pulse signal CK1 itself is changed over. In the circuit construction shown in FIG. 4, the clock generator 26 is constructed such that the frequency of a clock pulse signal CK1 generated therefrom is determined by a time constant of a resistor 30 and condensers 28 and 29. The condenser 28 can be disconnected by a switch 27. With such a construction, the switch 27 is turned on and off in accordance with an output of the timer circuit 24 for determining the heating time so that the frequency of the clock pulse signal CK1 is correspondingly changed Alternatively, a similar effect can be obtained by keeping the value of the condenser constant and changing over the value of the resistor 30 in accordance with the output of the timer circuit 24.

Figure 5:
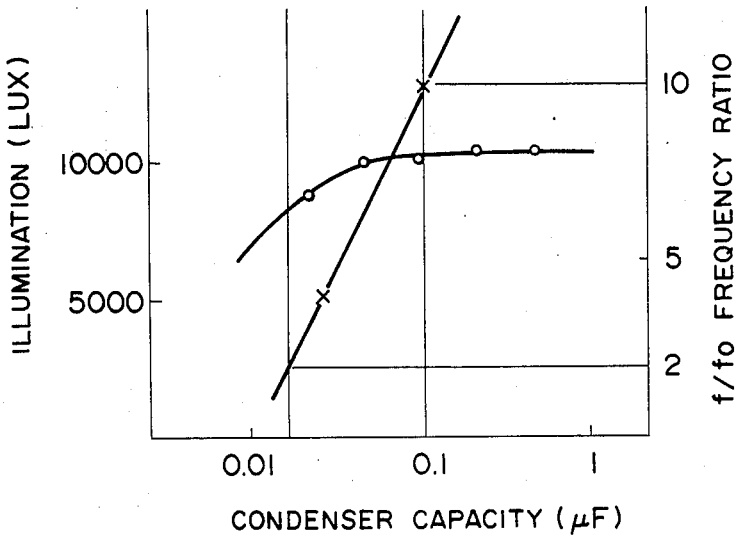
FIG. 5 is a graph showing an effect of the present invention or relations of the capacity of a condenser with illumination and frequency ratio.

In the present embodiment, the capacity of the condenser 4 as a ballast is selected in accordance with the teaching of the present invention to be a large value such that the charging and discharging is not completed or terminated during one period. The discharge lamp 3 used in the present embodiment is an inner tube separation type of fluorescent lamp in which the inner diameter of the inner tube is 14 mm and the total length of the inner tube 350 mm. The capacity of the condenser 4 is 0.033 $\mu$F and the time constant thereof is 10 $\mu$s when a power input of 20W at 50 KHz is applied. The illumination obtained is 9800 lux. FIG. 5 shows the results of measurement of the illumination when the condenser capacity and the ratio of the frequency f at the time of operating to the frequency $f_0$ at the time of heating are changed. The frequency ratio $f/f_0$ is selected such that the value of a current flowing through the condenser is 600 mA at the time of heating and 300 mA at the time of operating. It is seen from FIG. 5 that the frequency ratio $f/f_0$ not smaller than 2 is necessary in order to obtain an illumination equivalent to the conventional value of illumination and the frequency ratio $f/f_0$ not larger than 10 is enough to enhance the illumination by 18% as compared with the conventional value. When the capacity of the ballast condenser exceeds 0.1 $\mu$F, there results in no improvement of the efficiency as well as the increase of the volume or size of the condenser. Therefore, the upper limit of the ballast condenser capacity is 0.1 $\mu$F.

As has been described in the above, according to the present invention, the luminous efficiency of a discharge lamp in a discharge lamp operating circuit using a condenser as a ballast can be improved up to 18% without causing the damage of filament electrodes, by selecting the current frequency at the time of heating to be ½ to 1/10 of that at the time of operating in the case where it is desired to improve the efficiency by increasing the condenser capacity.

We claim:

1. A discharge lamp operating circuit comprising:

a switching circuit including first and second switch circuits connected in parallel with each other, said first switch circuit having series-connected first and second switches in which one end of said first switch and one end of said second switch are connected to each other, said second switch circuit having series-connected third and fourth switches in which one end of said third switch and one end of said fourth switch are connected to each other;

a discharge lamp including a first heating type of electrode connected between a central connection point of said first switch circuit and a central connection point of said second switch circuit and a second heating type of electrode connected between a second end of said second switch and a second end of said fourth switch;

a ballast condenser connected to said discharge lamp;

a DC power source connected between second ends of said first and third switches and said second ends of said second and fourth switches;

a switch control circuit for controlling turn-on and turn-off of said first to fourth switches to effect heating, starting and maintaining operation of said discharge lamp at a high frequency;

a capacitance of said ballast condenser being selected so that a time required for charging and discharging said ballast condenser is longer than a time scheduled for charging and discharging said ballast condenser in one period of said high frequency; and a switching frequency $f_0$ at the time of heating of said discharge lamp being selected to be smaller than a switching frequency f at the time of maintaining operation of said discharge lamp wherein said switching frequencies $f_0$ and f satisfies a relation of $2 \leqq f/f_0 \leqq 10$.

* * * * *